US005658434A

United States Patent [19]

Schlösser

[11] Patent Number: 5,658,434

[45] Date of Patent: Aug. 19, 1997

[54] COKE-OVEN DOOR ASSEMBLY

[75] Inventor: Rainer Schlösser, Essen, Germany

[73] Assignee: Krupp Koppers GmbH, Essen, Germany

[21] Appl. No.: 559,820

[22] Filed: Nov. 17, 1995

[30] Foreign Application Priority Data

Dec. 17, 1994 [EP] European Pat. Off. ..... 94120065

[51] Int. Cl.[6] ..... C10B 1/06; C10B 25/06; C10B 25/24

[52] U.S. Cl. ..... 202/248; 202/246; 202/269; 110/173 R

[58] Field of Search ..... 202/248, 242, 202/269, 246; 110/173 R

[56] References Cited

U.S. PATENT DOCUMENTS

| | | | |
|---|---|---|---|
| 4,152,216 | 5/1979 | Nishiura et al. | 202/248 |
| 4,189,352 | 2/1980 | Stanke | 202/248 |
| 4,400,240 | 8/1983 | Abendroth | 202/248 |
| 4,770,749 | 9/1988 | Schlösser | 202/242 |
| 5,238,539 | 8/1993 | Baird | 202/248 |
| 5,254,222 | 10/1993 | Mazzini et al. | 202/248 |
| 5,306,396 | 4/1994 | Schlösser et al. | 202/242 |

FOREIGN PATENT DOCUMENTS

| | | |
|---|---|---|
| 2755020 | 6/1979 | Germany . |
| 27 55 020 | 6/1979 | Germany . |

*Primary Examiner*—Nina Bhat

*Attorney, Agent, or Firm*—Herbert Dubno; Andrew Wilford

[57] ABSTRACT

A coke-oven door assembly has a rigid door, a mounting block adjacent the door, a door-plug backing plate fixed to the mounting block, and a membrane having a center portion between the backing and mounting blocks and a periphery juxtaposed with a coke-oven door jamb. A blade-type seal is carried on the periphery and engageable with the door jamb and spring units on the door press the seal against the door jamb. A plurality of bolts threaded into the mounting block extend generally perpendicularly outward from the membrane and are each formed with an abutment shoulder directed outward away from the membrane. A plurality of sleeves threaded into the door slidably receive the bolts and are each formed with an abutment shoulder directed inward toward and engageable with the respective bolt abutment so that the mounting block can move perpendicular to the membrane relative to the door with separation of each bolt abutment from the respective sleeve abutment.

6 Claims, 5 Drawing Sheets

COKE-OVEN DOOR ASSEMBLY

FIELD OF THE INVENTION

The present invention relates to a door assembly for a coke oven. More particularly this invention concerns such a door assembly incorporating a so-called seal membrane.

BACKGROUND OF THE INVENTION

A standard coke-oven door has a membrane whose center portion is fixed via mounting blocks to the door structure and whose periphery is equipped with a blade-type seal that is pressed by spring units against the annular door jamb of the coke oven. The membrane can deform to follow thermal deformations of the various parts which in use are heated greatly. The mounting blocks are attached to a backing plate of a large door plug normally formed at least partially of refractory material so that the door plug serves primarily to hold the material in the coking chamber while the membrane serves mainly to prevent gases and heat from escaping. During use the door is subjected to enormous thermal stresses and deforms as a result so that the spring units keep the blade-type seal pressed against the door jamb with some deformation of the membrane.

As described in German patent document 2,755,029 of T. Ikio et al the mounting blocks are carried via stacks of spring washers on the door frame so that they can move somewhat and at least partially follow the movement of the membrane. This is intended to reduce deformation of the membrane as such deformation eventually leads to its failure. Even so, the service life of the membrane is very short compared to the other elements of the coke oven, so that the entire battery must be brought down periodically for replacement of damaged and leaking membranes.

OBJECTS OF THE INVENTION

It is therefore an object of the present invention to provide an improved coke-oven door assembly.

Another object is the provision of such an improved coke-oven door assembly which overcomes the above-given disadvantages, that is whose membrane can be counted on to have a long service life.

SUMMARY OF THE INVENTION

A coke-oven door assembly has according to the invention a rigid door, a mounting block adjacent the door, a door-plug backing plate fixed to the mounting block, and a membrane having a center portion between the backing and mounting blocks and a periphery juxtaposed with a coke-oven door jamb. As is standard, a blade-type seal is carried on the periphery and engageable with the door jamb and spring units on the door press the seal against the door jamb. In accordance with the invention a plurality of bolts threaded into the mounting block extend generally perpendicularly outward from the membrane and are each formed with an abutment shoulder directed outward away from the membrane. A plurality of sleeves threaded into the door slidably receive the bolts and are each formed with an abutment shoulder directed inward toward and engageable with the respective bolt abutment so that the mounting block can move perpendicular to the membrane relative to the door with separation of each bolt abutment from the respective sleeve abutment.

The instant invention provides two degrees of freedom via the adjusters formed by the sleeves and bolts so that the membrane can stay planar even if the door frame deforms considerably. Even if at the start of a coking operation the entire door structure deforms, as is standard, the spring units will press the membrane periphery against the planar door jamb and the adjusters will permit the center portion to follow and hold the membrane planar. When the door is opened and closed frequently, as is common in a high-volume coking operation, the membrane will remain relatively planar and therefore can be counted on to have a very long service life.

According to the invention the door includes an annular door frame juxtaposed with the door jamb, and a plurality of crosspieces each aligned with a respective one of the mounting blocks and each threadedly receiving a respective one of the sleeves. While it is possible for the assembly to have just one fairly flexible mounting block carried by a plurality of adjusters, according to the invention the assembly has a plurality of such mounting blocks each provided with a respective one of the sleeves. The crosspieces extend horizontally and are vertically spaced from one another. In addition a spacer plate is provided at each mounting block between the membrane and the backing plate.

Moreover according to the invention each bolt has an outer end forming an inwardly directed abutment and each sleeve has an outer end forming an outwardly directed abutment. The spacing between the bolt abutments is smaller by a predetermined distance than the spacing between the sleeve abutments so that each bolt can move inside the respective sleeve through the distance.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
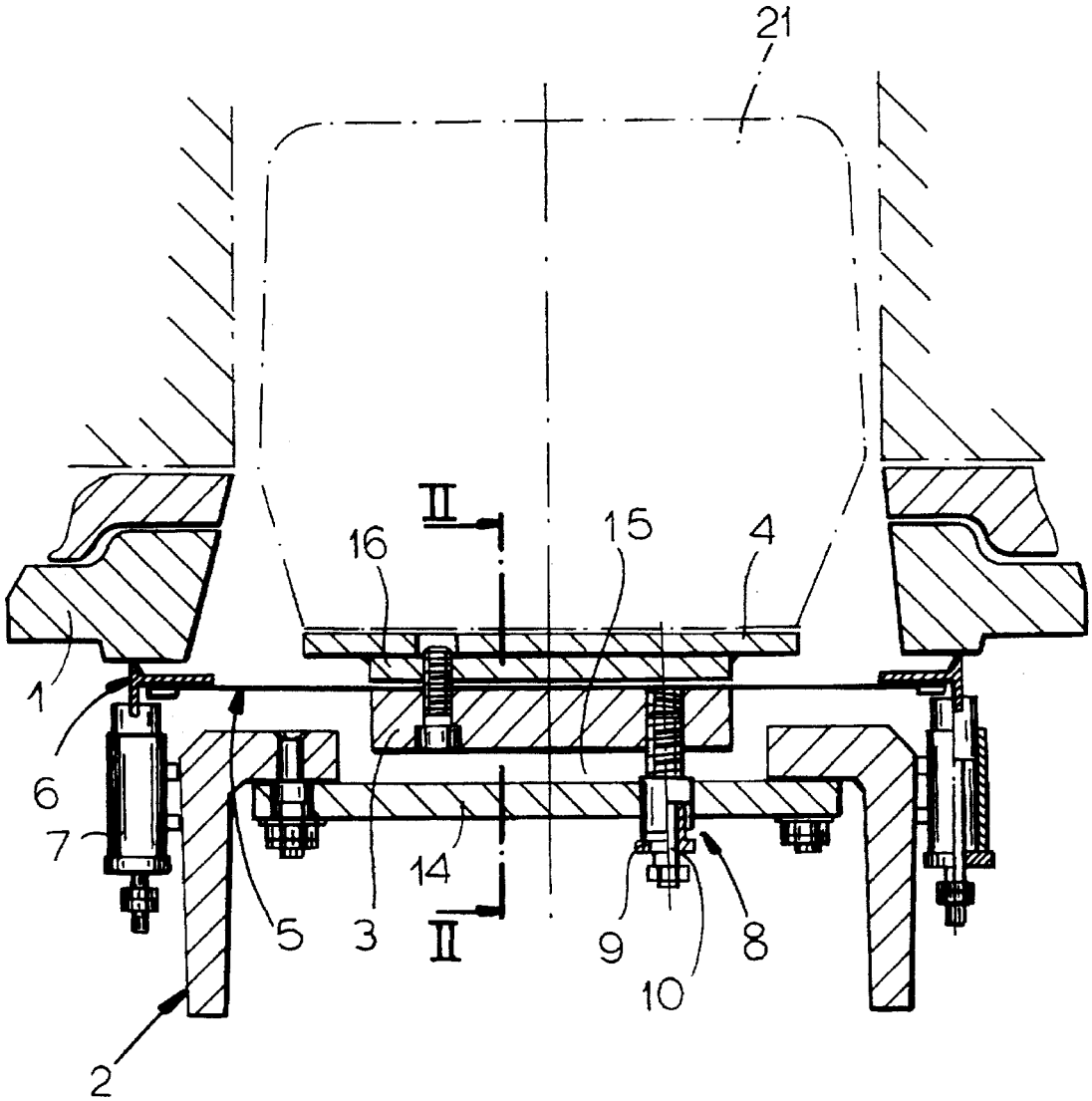
FIG. 1 is a small-scale horizontal section through a door assembly according to the invention.
Figure 2:
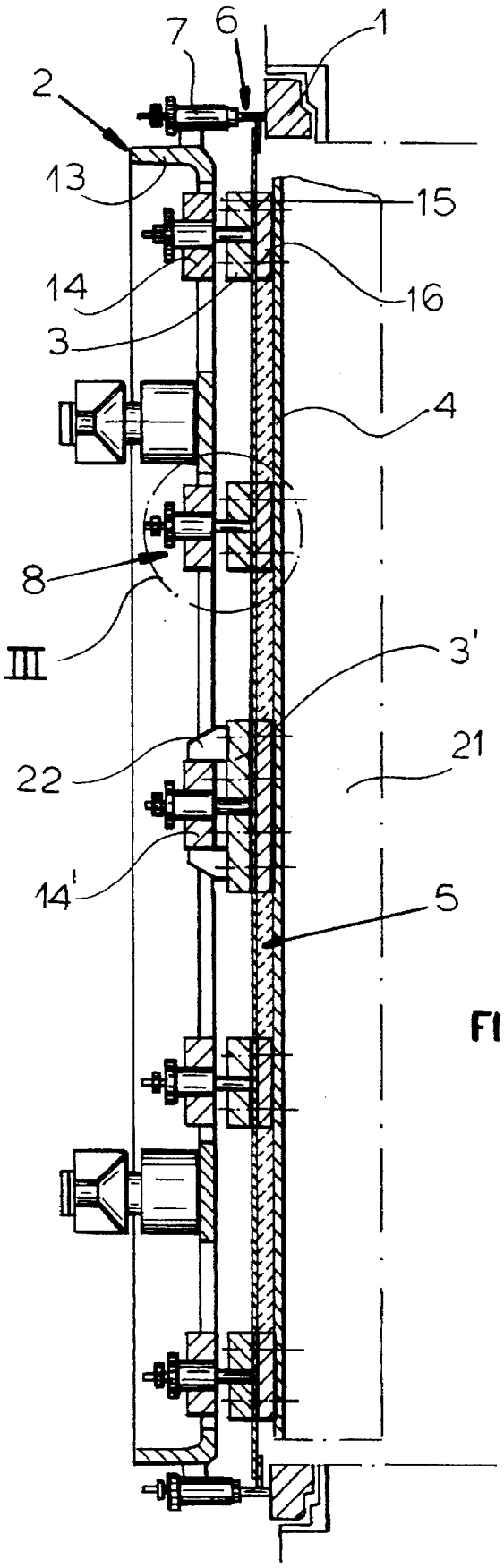
FIG. 2 is a vertical section taken along line II—II of FIG. 1.
Figure 4:
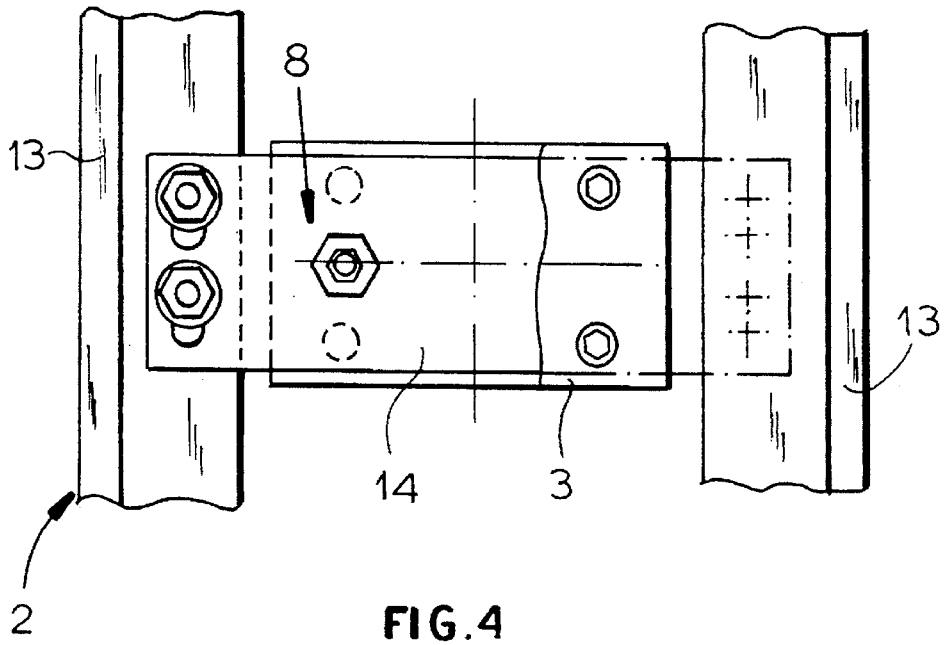
FIG. 4 is a front view in the direction of arrow IV of FIG. 3.
Figure 5:
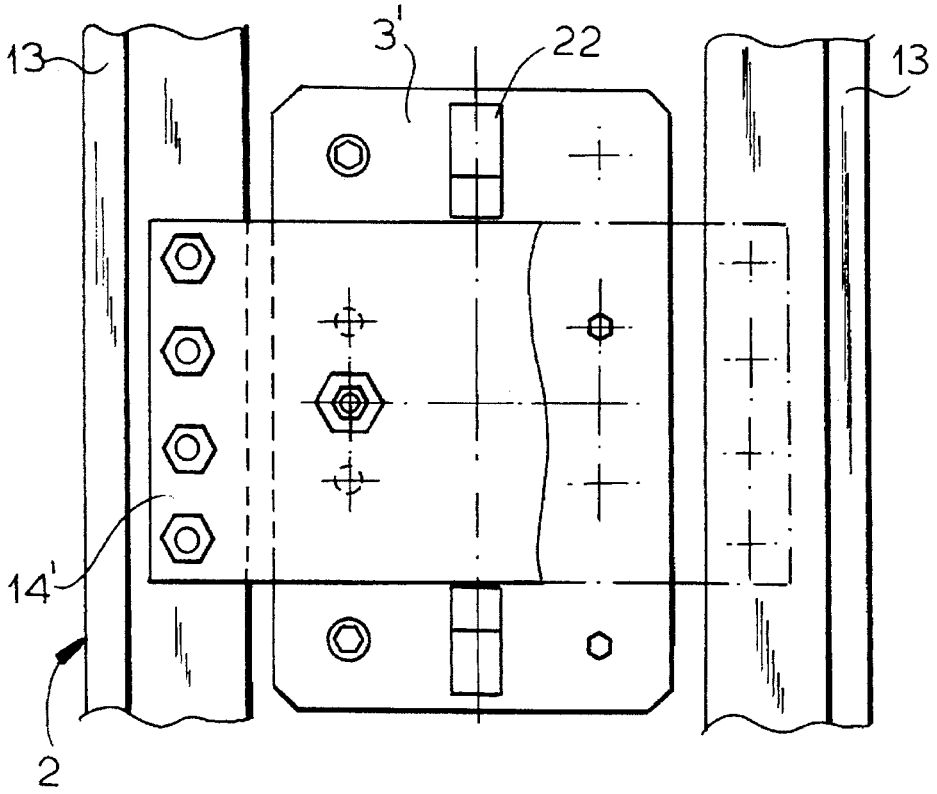
FIG. 5 is a front view like FIG. 4 of another part of the door assembly.

As seen in FIGS. 1 and 2 a coke oven according to this invention has an annular door jamb 1 that is basically rectangular and vertically elongated. A coke-oven door has a frame 2 carrying one or more, (here five) mounting plates or blocks 3 themselves connected to a backing plate 4 of a door plug 21 of refractory material. The door frame 2 as shown in FIGS. 4 and 5 comprises an L-section outer frame member 13 and a plurality of stiff crosspieces or plates 14 bolted to and bridging its elongated vertical side parts each separated by a spacing 15 from the respective mounting block 3. A generally planar and rectangular membrane 5, typically made of a flexible metal, is secured to the mounting blocks 3 and has an outer periphery provided with a standard blade-type seal 6 that is pressed against a planar outer face of the jamb 1 by a plurality of spring units 7 mounted on the door frame 2. The membrane 5 is sandwiched between inner faces of the blocks 3 and outer faces of spacer plates 16 bolted with the blocks 3 to the backing plate 4 of the plug 21.

Figure 3:
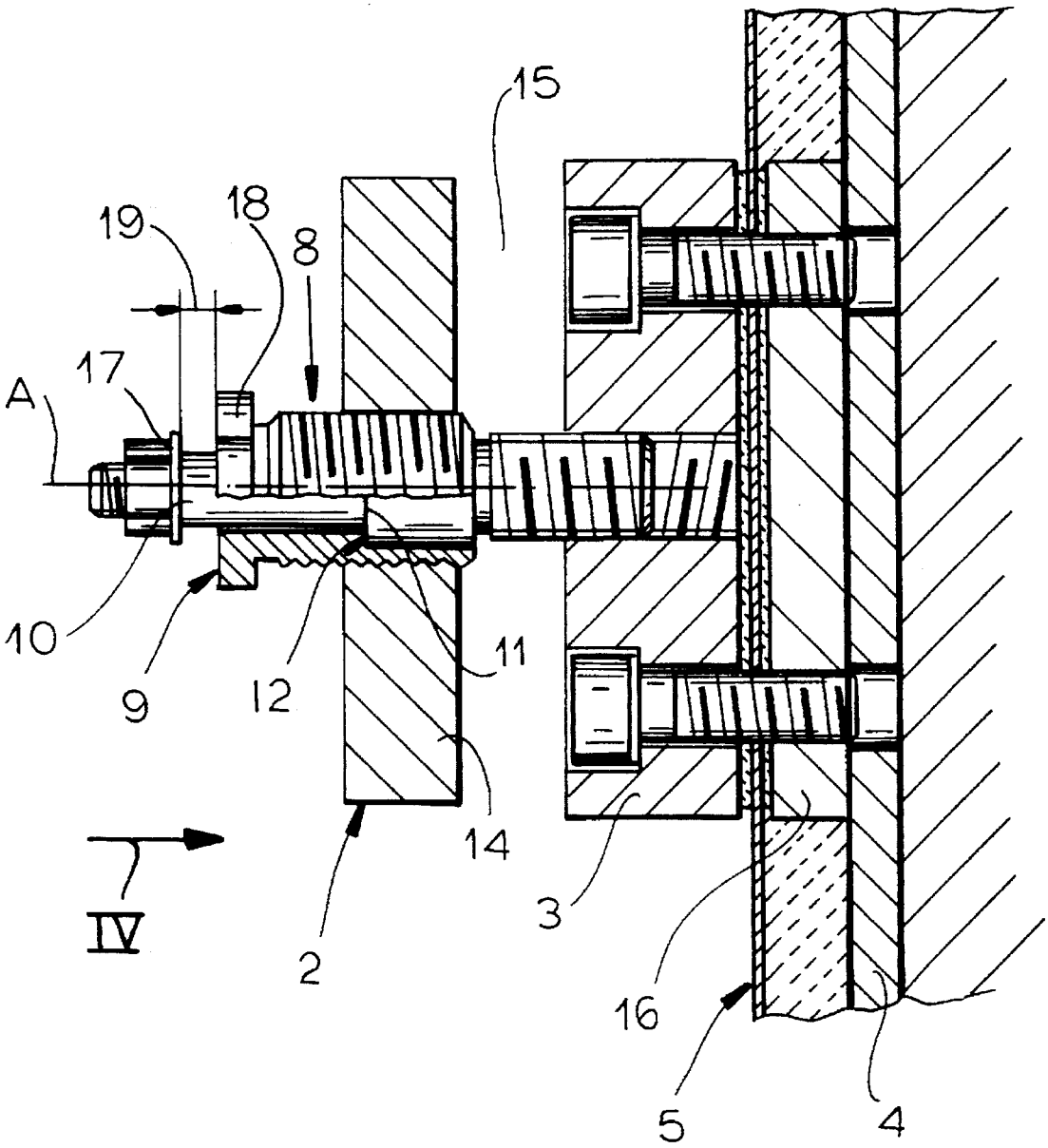
FIG. 3 is a larger-scale view of the detail indicated at III in FIG. 2.

The mounting blocks 3 are carried on these crosspieces 14 by means of adjusters 8 each comprised as seen in FIG. 3 of an externally threaded outer sleeve 9 threaded into the crosspiece 14 and an externally threaded inner screw or bolt 10 threaded into the mounting block 3 and sliding along an axis A inside the sleeve 9. The sleeve 9 has an axially inwardly directed abutment shoulder 11 that axially confronts and is engageable with an axially outwardly directed abutment shoulder 12 of the screw 10. In addition the screw carries at its outer end a nut forming an inwardly directed abutment 17 axially confronting another axially outwardly directed abutment surface 18 formed on a nut-like outer end of the sleeve 9. The axially oppositely directed abutments 11 and 18 of the sleeve 9 are axially spaced by a distance that is shorter by a spacing 19 than the axial spacing between the confronting abutments 12 and 17 of the bolt 10. It is therefore possible for each block 3 to shift through a distance equal to the spacing 19 relative to the respective crosspiece 14. This affords some ability of the membrane 5 to adjust for thermal deformations of its surroundings and stay fairly planar, maximizing its service life.

Figure 6:
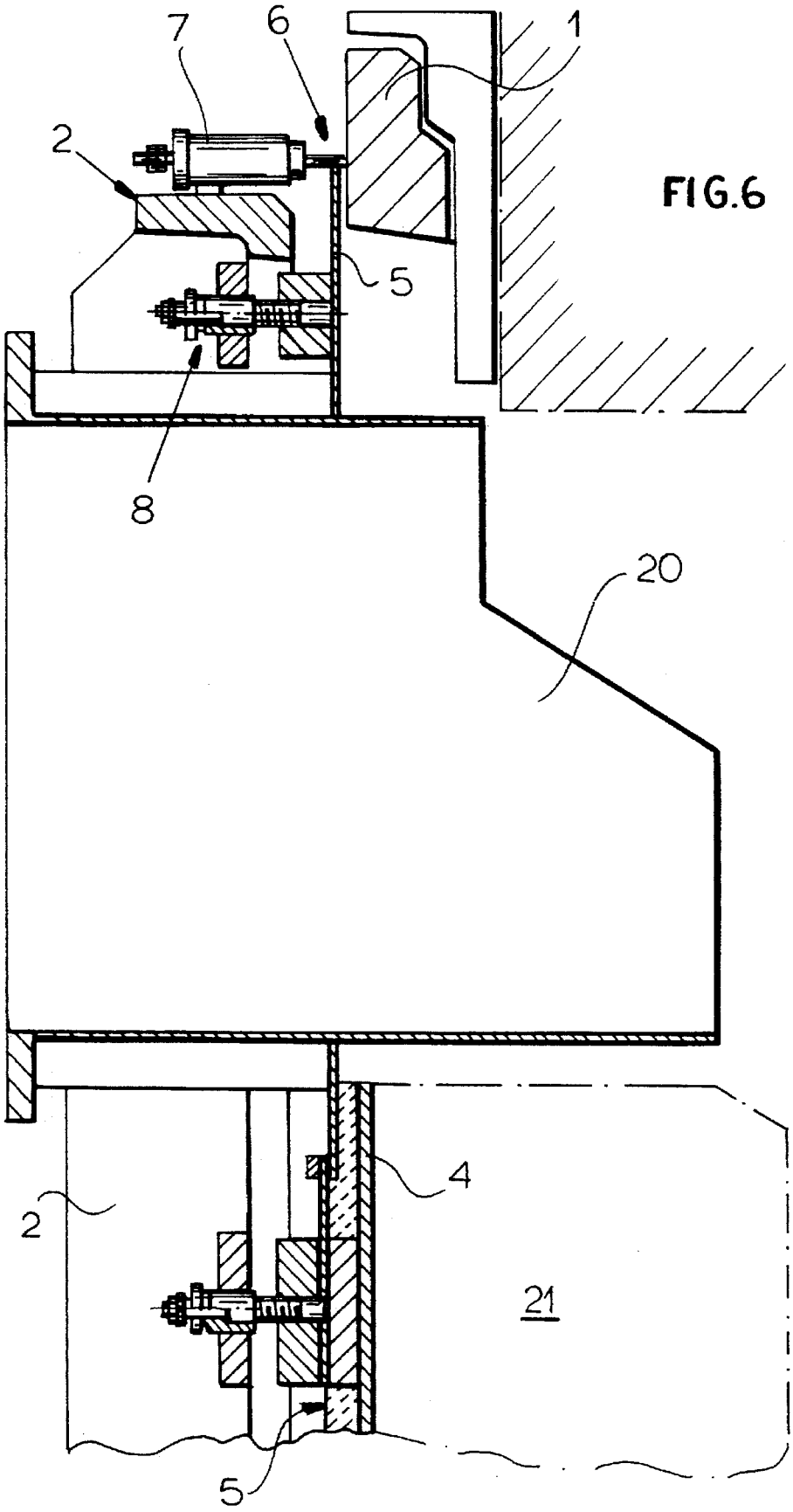
FIG. 6 is a vertical section through yet another part of the door assembly.

FIGS. 2 and 5 show how a mounting block 3' can be equipped with upper and lower alignment tabs 22 that ride on upper and lower edges of the respective crosspiece 14' to ensure proper vertical positioning of the door plug 21. FIG. 6 shows how a coke-leveling access port 20 can be secured directly to the membrane 5 between adjacent adjusters 8.

I claim:

1. A coke-oven door assembly comprising:

a rigid door frame;

a mounting block adjacent and spaced from the door frame;

a door-plug backing plate fixed to the mounting block;

a membrane having a center portion between the backing plate and mounting block and a periphery juxtaposed with a coke-oven door jamb;

a blade seal carried on the periphery and engageable with the door jamb;

spring units spaced on the door frame around the seal and pressing the seal against the door jamb;

a plurality of bolts threaded into the mounting block, extending generally perpendicularly outward from the membrane, and each formed with an abutment directed outward away from the membrane; and a plurality of respective sleeves threaded into the door frame, slidably receiving the bolts, and each formed with an abutment directed inward toward and engageable with the respective bolt abutment, whereby the mounting block and membrane center portion can move perpendicular to the membrane inward relative to the door frame with separation of each bolt abutment from the respective sleeve abutment.

2. The coke-oven door assembly defined in claim 1 wherein the door frame includes an annular frame element juxtaposed with the door jamb, and a plurality of crosspieces each aligned with a respective one of the mounting blocks and each threadedly receiving a respective one of the sleeves.

3. The coke-oven door assembly defined in claim 1 wherein the assembly has a plurality of such mounting blocks each provided with a respective one of the sleeves.

4. The coke-oven door assembly defined in claim 3 wherein the crosspieces extend horizontally and are vertically spaced from one another.

5. The coke-oven door assembly defined in claim 1 further comprising a spacer plate at each mounting block between the membrane and the backing plate.

6. The coke-oven door assembly defined in claim 1 wherein each bolt has an outer end forming an inwardly directed abutment and each sleeve has an outer end forming an outwardly directed abutment, the spacing between the bolt abutments being smaller by a predetermined distance than the spacing between the sleeve abutments, whereby each bolt can move inside the respective sleeve through the distance.

* * * * *